US006497605B1

(12) United States Patent
Cummings et al.

(10) Patent No.: US 6,497,605 B1
(45) Date of Patent: Dec. 24, 2002

(54) OPERATOR CONTROLLED MULTILINGUAL DOLL

(76) Inventors: Charels A. Cummings, 5719 Tomaridge Dr., Cincinnati, OH (US) 45248; Joanne Gerson, 7714 Stonehenge Dr., Cincinnati, OH (US) 45242

( * ) Notice: Subject to any disclaimer, the term of this patent is extended or adjusted under 35 U.S.C. 154(b) by 0 days.

(21) Appl. No.: 09/919,245

(22) Filed: Jul. 31, 2001

(51) Int. Cl.[7] ..... A63H 3/28

(52) U.S. Cl. ..... 446/297; 434/157; 434/169; 446/404

(58) Field of Search ..... 446/297, 302, 446/369, 397, 404; 434/156, 157, 167, 169, 185, 393

(56) References Cited

U.S. PATENT DOCUMENTS 4,221,927 A * 9/1980 Dankman et al. ..... 367/198
4,696,653 A * 9/1987 McKeefery ..... 434/308
5,004,442 A * 4/1991 Lemelson et al. ..... 446/268
5,376,038 A * 12/1994 Arad ..... 446/297
5,738,561 A * 4/1998 Pracas ..... 446/297

FOREIGN PATENT DOCUMENTS

CA 02285607 A1 * 4/2002
DE 003345978 A1 * 6/1985 ..... 446/297

* cited by examiner

*Primary Examiner*—Derris H. Banks
*Assistant Examiner*—Bera B. Miller

(57) ABSTRACT

The operater controlled bilingual or multilingual toy is a toy, such as a doll, with a programmable controllable voice synthesizer. The circuit of the toy, when activated, synthesizes a first random phase selected from a bank of phrases. When activated a second time the circuit of the toy will reproduce that first phrase as a translated phrase in a second language. After a specified elapse of time, or a continued reactivation within a specified period of time, this process is repeated by the choice of a second, third, and so forth randomly accessed phases. Each of the phrases is followed by a translation of that phases. If neither the manual switch or a second motion switch is operator activated within a predetermined time, the toy will turn itself off.

20 Claims, 3 Drawing Sheets

OPERATOR CONTROLLED MULTILINGUAL DOLL

FIELD OF INVENTION

The field of the present invention is concerned with toys such as dolls which have electronic speech synthesizer which will produce a phrase or sentence in a first language and, after a selected delay, the speech synthesizer will produce a useful translation of the phrase of sentence of the first language into a second language such as English. This toy could likewise be used to teach vocabulary words. Three or more languages may be programmed into this doll or toy. The present invention will allow a playful way of reinforcing language study.

The present invention is concerned with several fields. It is concerned with toy forms such as a doll, stuffed animal or robot. The figure may be covered in appropriate material to convey the theme of the toy. It is concerned with reinforcing the teaching of languages or it may teach certain sounds such as those of animals, machines, or toy robots. The means of providing speech for these toys is electronic voice synthesizers and an electronic storage of the phrases for a first language and the smooth translation of the phrases of the first language into a second, third, or more languages.

When the on switch is activated said voice synthesizer will produce a random phrase from a selected group or phrases or sentences in a first language. After a programmed delay, a useful translation of said produced random phrase or sentences of said first language will be synthesized in a second language.

It is to be noted that the mechanism which produces the programed delay between the first sentence or phrase and the translation of the first phrase may be specified by either a simple time period or a stimulus such as pushing a part on the doll, or movement of the toy, or sound or light.

A further teaching of the present invention is that if the toy is idle for period of time, the toy will automatically turn itself off to save battery power The present invention teaches that the dress or physical aspects of the doll or toy will reflect the culture or theme of the first language that is in the speech synthesizer cycle.

In addition, the individual units of the present invention may be merchandised in a kit to reflect a social situation. That is two or more dolls may be dressed with accessories so that they my imitate those whom would be acting as if in a social situation such as attending an international ball.

BACKGROUND OF INVENTION

There are a number of doll and toys that speak after an interaction with the child. U.S. Pat. No. 5,501,627, Ekstein, teaches a toy that gives a verbal response to a stimulus from a child. U.S. Pat. No. 4,696,653 McKeffery describes s doll that responds with random phrase to spoken words or touch. U.S. Pat. No. 4,717,363 teaches a doll that responds to the heat of the child as the child approaches that doll. U.S. Pat. Nos. 6,024,571, 5,946,658, and 5,842,146 teach that toys can be used to respond to the actions of the child and can be used to teach foreign languages. U.S. Pat. No. 6,053,797 teaches a doll that responds to mechanical stimulation through sensors located on various parts of the body.

SUMMARY OF THE INVENTION

The object of the present invention is a toy that can entertain and teach foreign language phrases or produce a kind of sound that requires interpretation. This process of the present invention has a speech synthesizers which will create one of a number of phrases followed by the translation of the phrases or in a second language. This process is provided either by squeezing a switch on the toy, by time delay, by other external stimulation, or by electronic means as described in the detailed description of the invention.

DETAILED DESCRIPTION OF INVENTION

Figure 1:
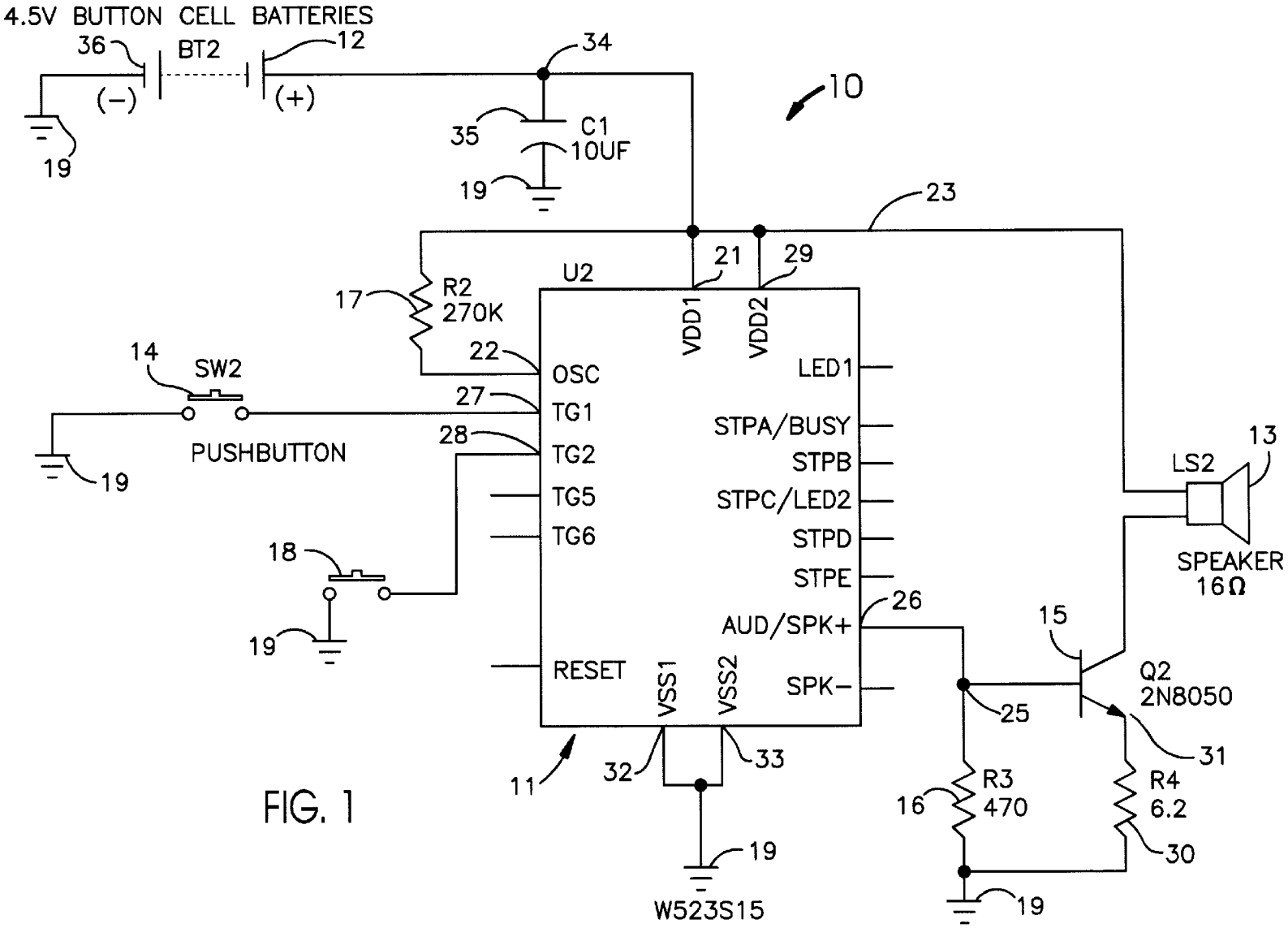
FIG. 1 is a schematic of the electronic circuit of the toys, according to the invention.
Figure 4:
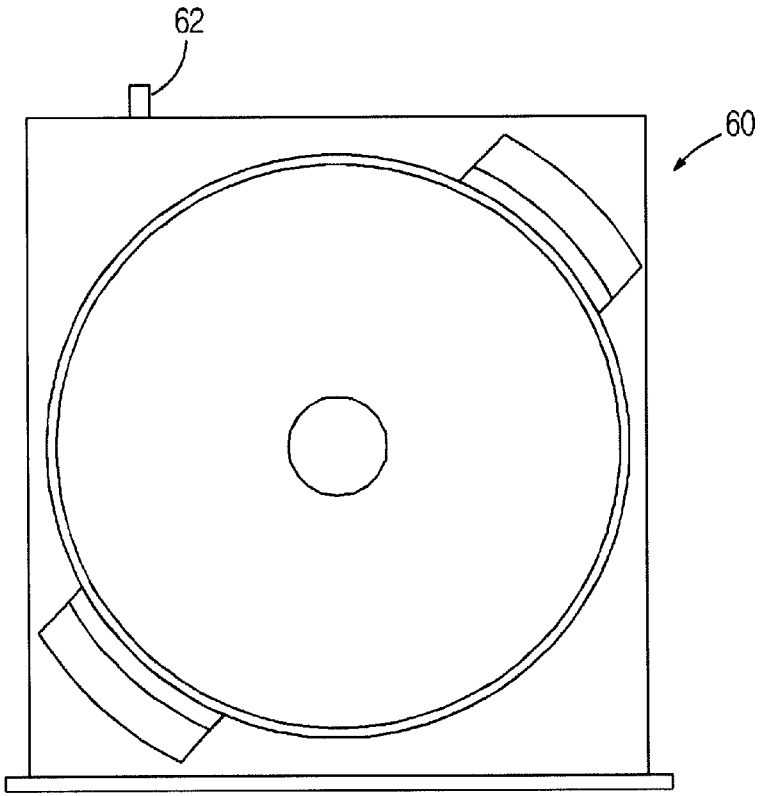
FIG. 4 is a plate in the form of a CD-like disk, according to the invention.
Figure 2:
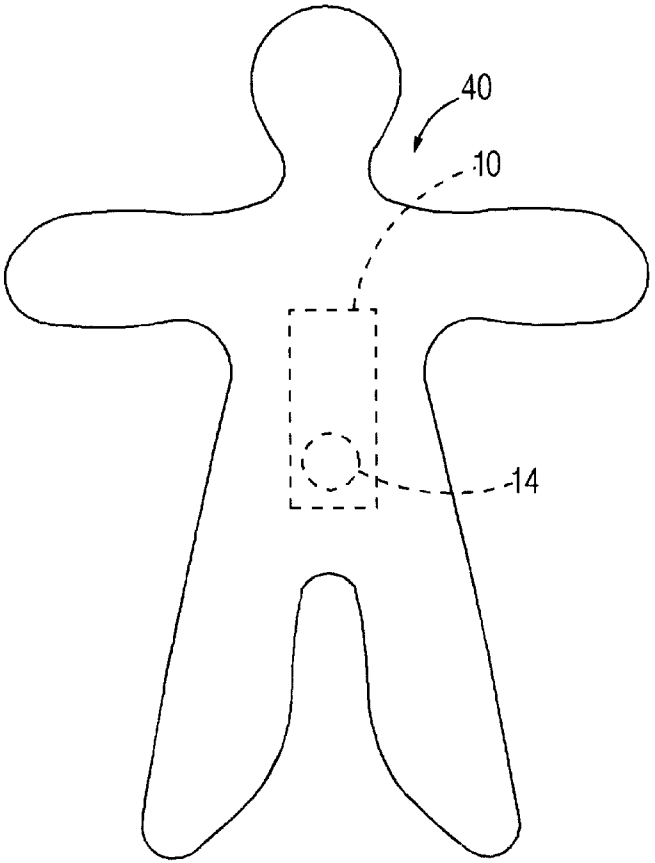
FIG. 2 is a toy body in the form of a doll, according to the invention.
Figure 3:
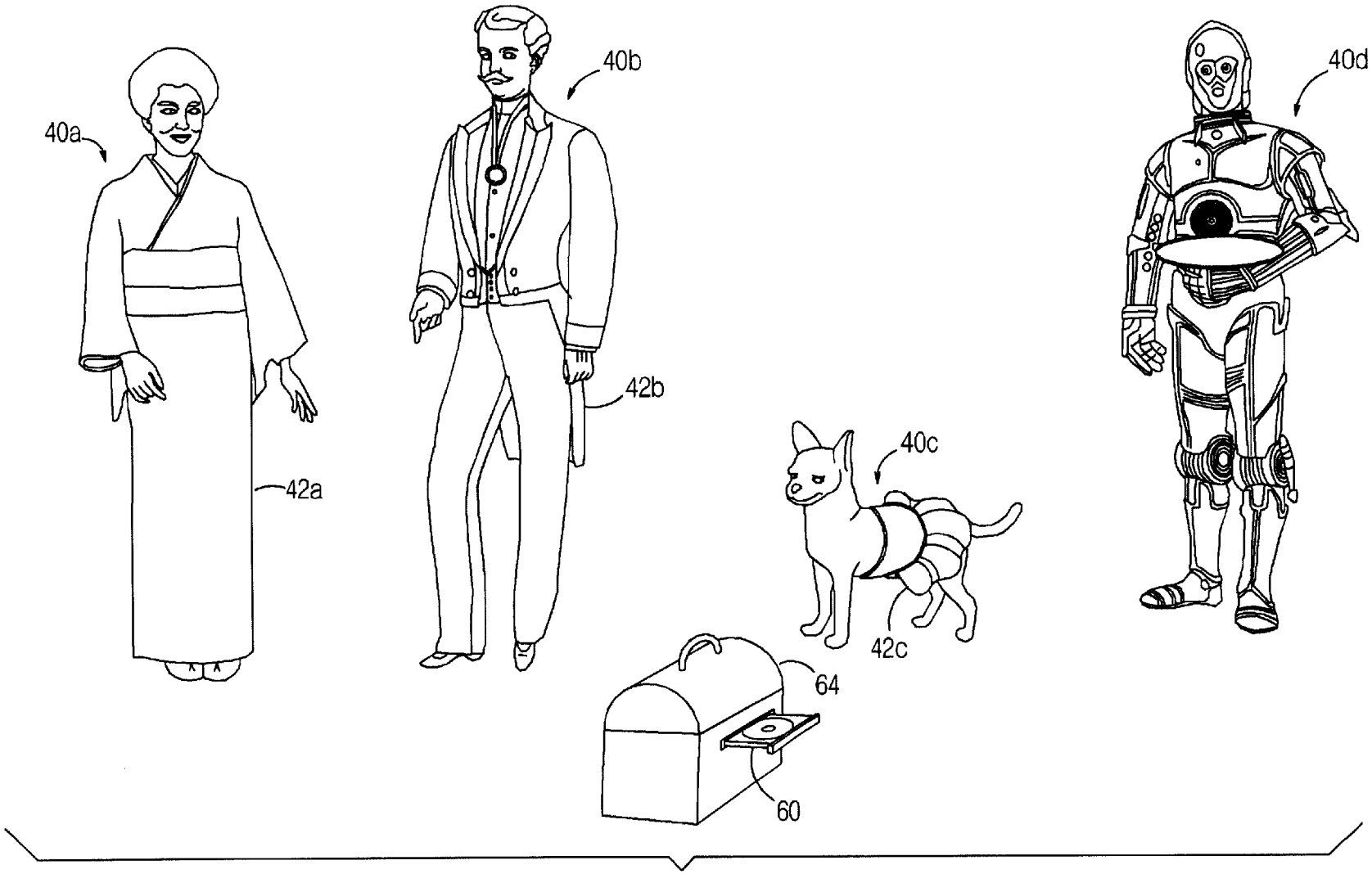
FIG. 3 is a series of toys, including one or more toys and accessories, according to the invention.

A generic description of the present invention is as follows: The present invention has a toy form (40) such as a doll with a circuit (10) comprising a programmable computer chip with a speech or voice synthesizer (11). This toy has a first activation step. This activation step "turns the toy on." This toy has an activation means for this first activation step. This activation means can be a manual switch (14) such as a squeeze button. Likewise, it can be activated by voice, movement, radio, or optical sensors and so forth. Upon activation, the toy (40) synthesizes a phrase from a random selection in a first language. After a programmed delay that phrase in the first language may be synthesized as a translation in a second language. The programmed delay between the synthesis of the first language phrase and the syntheses of the second language phrase may be determined by a previously determined time, or by a sound activation switch, or by a motion switch, or by light, or a squeeze button. As long as the operator keeps playing with the toy that toy will continue to repeat the several various random voice phrases and the respective translations for an indefinite time. However, a "turn off" switch is activated by the elapse of a previously determined time if the toy is left idle.

It is to be noted that the present invention is not confined to actual human languages or vocabulary building. The principle of this invention could be used to provide such situations as "robot" talk, machine sounds, animal sounds, and so forth.

A description of the present invention in a specific embodiment is as follows: Operator Controlled Multilingual Doll (40) is activated by the child picking up the doll (40) or figure. More specifically, commences operation by the child squeezing the abdomen. This squeeze is typically done between the thumb and forefinger or activated through a time delay or other external activation means. When activated by such a squeeze or other activation means, the doll (40) synthesizes a random phrase from a predetermined group of phrases in the selected foreign language. When squeezed again, the phrase is spoken, translated into a second language, possibly English.

A unitarian series of toys (50) related to a specific topic teaches one embodiment of the present invention. This embodiment provides additional parts, including one or more dolls **(40*a*, 40*b*, 40*c*, 40*d*, collectively referred to as dolls (40) or toys (40)) each being dressed in the native garb. Such a doll may be a French appearing doll. Likewise, for a proposed situation, a "Spanish" doll synthesizing Spanish phrases or a "German" doll synthesizing German and so forth would be available. In a play situation, these dolls with extra parts as accessories (64) such as carrying case and a carriage pulled by horses will provide a unitarians series of toys (50) to play as if in a central theme such as attending a great international ball. In such a play situation, the random phrases would relate to that central theme, the international ball. One or more of the additional parts would be a CD like disk (60) in the form of a molded plastic plate containing a pin (62)** to access the musical electronics to provide a music to complement specific play topic or nationality.

Each doll (40) has the same group of phrase from a random bank of phrases which are randomly accessed when the doll (40) is squeezed. The phrases are so chosen that they all relate to each other and, therefore, when a doll A (e.g., 40*a*) is squeezed, and its companion, a doll B (e.g., 40*b*), is squeezed these dolls (40) would appear to be communicating. Thus doll A could speak, "I like to go to the ball," Doll B could speak, "I like to ride in the carriage." If the doll (40) is not squeezed within a predetermined time, the electronics (10) automatically shut off.

Each doll comes with a CD like disk (60) when inserted into a slot in the accessories (such as a ball room carrying case) the CD like disk (60) plays a musical tune relative to the country depicted. Such a carrying case is an accessory (64) with the dolls. Normally the carrying case (64) is designed to reflect a theme, such as the above mentioned international ball. Then the CD like disk (60) is inserted into the carrying case (64), music relating to that country and/or theme is played.

The random phrases from a random bank of phrases spoken by each doll (40), as dressed for a specific country, should be a logical statement regardless of which of the national dolls speaks first. Each doll (40) speaks first in its native language, but can be cause to speak the same phrase in a second language such as English when squeezed within a predetermined time. In other words, if the operator does not understand the particular language, he or she may readily determine what the doll (40) said by squeezing the doll again to hear the phrase in English.

The number of toy forms (40) are limited only by the imagination of the toy designer. By squeezing the body of the toy form or other external activation, the toy form (40) could sing, count, or spell words in its native language and by squeezing or other activation means again repeat the same phrase translated into English or another second language.

Modern electronics provide much flexibility in design. While the detailed circuitry (10) or the preferred embodiment has been reduced to practice following the detailed description, it is to be understood that many other circuits could produce the equivalent of the present invention.

Electronics (10) are contained in the doll for the multilingual speaking of random phrases. The CD like disk (60) is only a molded plastic plate containing a pin (62) to access the musical electronics in the carrying case. The carrying case (64) contains electronics for musical melodies for several nations, each accessed by a pin (62) located on the CD like disk plate (60) that presses the appropriate switch contained within the ballroom carrying case (64).

The starting reference point of FIG. 1 is a programmable microchip computer controlled voice synthesizer (11) to make an interactive toy which produces phrases and translations of phrases of several languages or explanations of intelligent sounds. The toy form (40) of the present invention has a unitarian electronic circuit (10) in operational configuration as follows: Voice synthesizer computer chip (11) sold under the code W523S15 is manufactured by Winbond Electronics Corporation, Taiwan. This kind of chip (11) is a commodity article useful for the present invention. Manual switch (14), the motion activated switch (18) the battery pack power source (12), and the speaker or speakers (13) are interconnected through chip (11) and the ground connection (19). The connection on the computer chip (11) is VSS1 (32) and VSS2 (33) to ground connections (19). Computer chip (11) is grounded to ground (19) through pin VSS. The electric battery power source (12) connects through connector (21) to pin VDD1 and (29) pin VDD2. A voice output pin OSC of the chip (11) is through connected via connector section (22) to resistor (17) which in turn is connected through connector segment (23) to speaker (13) to complete the electric circuit to the computer chip is resistor controlled transistor type 2N8050 (15).

The capacitor (35) is connected from the battery (12) to ground (19). The circuit to be amplified is grounded through (19). The connection (26) between transistor (15) and the computer chip (11) is grounded by a resistor (16) through connector section (25) and the second resistor (30) through connector (31). The connection (26) is attached to the computer chip (11) at pin SPK. The computer chip (11) is activated by manual "ON"0 switch (14) which connects the ground and connects section (27) connector section (27) in turn connects to pin TGI on computer chip (11), and in turn to "On" switch (14). activated a second time, within 15 seconds the voice output is repeated in a second language. Switch (14) is located on the front of the doll (40). Motion switch (18) connects between the ground through connector section (28) to pin TG2 on computer chip (11). When activated (turned on) by motion, the computer chip (11) will deactivate the first appropriate phrases in the programmed chip to produce a phrase from the random bank in the native language.

If switch (14) is activated, a phrase from the programmed bank of phrases will be synthesized (spoken). Then, after a delay of 15 seconds, (other delay times may be useful), the phrase just spoken may be repeated in a second language. Note, the computer chips (11) is programmed to produce the first appropriate phrases when activated by manual switch (14) or by motion switch (18). However, the computer chip is further programmed to prevent for a limited time the second motion switch (18) from starting the second appropriate phrases after the first manual switch (14) is activated. This limited time will allow the toy to be played with pressing "ON" switch (14). The manual switch (14) takes precedence over the motion switch (18).

The chip (11) is programmed to turn itself off, after the second appropriate phrases, if there is no movement or if switch (14) is not activated within a predetermined time. The cycle is restarted by the activation of manual switch (14).

We claim:

1. An interactive toy which produces phrases and translations of the phrases, the toy comprising:

a body in the form of a doll;

a circuit within the body, the circuit comprising:

a programmable voice synthesizer for controlling the actions of the toy;

a first switch and a second switch, both switches being connected for controlling operation of the programmable voice synthesizer; and a speaker connected to the programmable voice synthesizer for voicing pre-programmed phrases of synthesized speech; and programming of the circuit such that:

when the first switch is activated, the programmable voice synthesizer will voice a phrase randomly selected from a bank of phrases in a first language; and when a trigger event occurs within a first predetermined time after activation of the first switch, a translation of the phrase is voiced in a second language.

2. The interactive toy as in claim 1 wherein when the second switch is activated after activation of the first switch, the programmable voice synthesizer will again voice a phrase randomly selected from the bank of phrases in the first language.

3. The interactive toy as in claim 2 wherein:

the first switch is manually activated by being pressed;

the second switch is activated by motion of the toy; and the circuit ignores activation of the second switch until after the first predetermined time has elapsed.

4. The interactive toy as in claim 1 wherein when the second switch is activated after the first predetermined time has elapsed, the programmable voice synthesizer will again voice a phrase randomly selected from the bank of phrases in the first language.

5. The interactive toy as in claim 1 wherein after a second predetermined time during which the toy is idle, the toy automatically turns off.

6. The interactive toy as in claim 1 wherein the doll is in a form selected from a group comprising human, animal, and robot.

7. The interactive toy as in claim 1 wherein the programmable voice synthesizer is a W523S15 programmable computer/speech synthesizing chip.

8. The interactive toy as in claim 1 wherein the doll is dressed in clothing suggestive of a particular culture or nationality.

9. The interactive toy as in claim 8 wherein the doll has clothing and physical characteristics suggestive of the particular culture or nationality wherein the first language is spoken.

10. The interactive toy as in claim 1 wherein the trigger event is conclusion of the first predetermined time after activation of the first switch.

11. The interactive toy as in claim 1 wherein the trigger event is activation of the first switch.

12. The interactive toy as in claim 1 wherein the trigger event is a sound stimulus.

13. The interactive toy as in claim 1 wherein the trigger event is a light stimulus.

14. The interactive toy as in claim 1 wherein:

the toy is turned on by activation of the first switch; and the toy shuts itself off when there is no trigger event within a second predetermined period of time following any activation of the first switch.

15. The interactive toy as in claim 1 wherein the phrase is a vocabulary word, and the translation of the phrase is a definition of the vocabulary word.

16. The interactive toy as in claim 1 wherein the phrase is an intelligent sound, and the translation of the phrase is an explanation of the intelligent sound.

17. A series of toys related to a specific topic comprising:

one or more toys, each with a circuit having programming, wherein each of the circuit comprises: a programmable voice synthesizer for controlling the actions of the toys; a switch connected for controlling operation of the programmable voice synthesizer; and a speaker connected to the programmable voice synthesizer for voicing pre-programmed phrases of synthesized speech;

programming of each of the circuit is such that: when the switch is activated, the programmable voice synthesizer will voice a phrase randomly selected from a bank of phrases in a first language; and when a trigger event occurs within a predetermined time after activation of the switch, a translation of the phrase is voiced in a second language;

one of a plurality of sets of pre-programmed phrases in each of the toys in the series of toys wherein each set of pre-programmed phrases is related to the specific topic such that the toys in the series of toys will appear to be communicating with each other; and accessories to complete a theme for the specific topic, wherein: a first accessory is a plate in the form of a CD-like disk with a pin, and a second accessory is a box designed to reflect the theme, the box containing musical electronics such that, when the plate is inserted into the box, the plate accesses the musical electronics to provide music to complement the theme.

18. The series of toys as in claim 17, wherein:

the musical electronics can provide music for musical melodies of a plurality of different nations; and the music of each of the different nation is selected according to a placement of the pin on the plate, wherein the pin presses one of a plurality of musical selection switches within the second accessory when the plate is inserted.

19. The series of toys as in claim 17, wherein the trigger event is conclusion of the predetermined time after activation of the switch.

20. The series of toys as in claim 17, wherein the trigger event is activation of the switch.

* * * * *